US005324123A

United States Patent [19]

Hattori

[11] Patent Number: 5,324,123

[45] Date of Patent: Jun. 28, 1994

[54] TAPE PRINTING DEVICE AND TAPE CASSETTE FOR PRINTING NORMAL IMAGE

[75] Inventor: Shigenori Hattori, Aichi, Japan

[73] Assignee: Brother Kogoy Kabushiki Kaisha, Nagoya, Japan

[21] Appl. No.: 980,721

[22] Filed: Nov. 24, 1992

[30] Foreign Application Priority Data

Feb. 7, 1992 [JP] Japan ..... 4-22622

[51] Int. Cl.[5] ..... B41J 35/28

[52] U.S. Cl. ..... 400/207; 400/208; 400/242; 400/243

[58] Field of Search ..... 400/208, 242, 196, 196.1, 400/194, 195, 207, 207 E, 243; 206/387; 354/275, 276

[56] References Cited

U.S. PATENT DOCUMENTS

| | | | |
|---|---|---|---|
| 4,511,721 | 4/1985 | Oberto | 400/208 |
| 4,732,499 | 3/1988 | Nojima et al. | 400/208 |
| 4,927,278 | 5/1990 | Kuzuya et al. | 400/208 |
| 4,944,618 | 7/1990 | Ideta . | |
| 4,966,476 | 10/1990 | Kuzuya et al. . | |
| 4,986,679 | 1/1991 | Kawaura | 400/208 |
| 5,104,247 | 4/1992 | Ohshima . | |

FOREIGN PATENT DOCUMENTS

| | | |
|---|---|---|
| 0260111 | 3/1988 | European Pat. Off. . |
| 0467414A2 | 1/1992 | European Pat. Off. . |
| 4022696A1 | 1/1991 | Fed. Rep. of Germany . |
| 3-68443 | 7/1991 | Japan . |
| 2223740A | 4/1990 | United Kingdom . |

*Primary Examiner*—Edgar S. Burr
*Assistant Examiner*—John S. Hilten
*Attorney, Agent, or Firm*—Oliff & Berridge

[57] ABSTRACT

A tape cassette has a prohibiting member which prevents the tape cassette from being loaded into a tape printing device without a mode appropriate for the tape cassette. When an operator tries to load the tape cassette into a printing device without a mode for the tape cassette, a prohibiting member provided on the main body of the tape cassette abuts an installation member of the tape printing device thus preventing improper loading. The prohibiting member also has a function as a reinforcement member and a positioning member for reinforcing the cassette case and ensuring proper loading in the device.

15 Claims, 8 Drawing Sheets

TAPE PRINTING DEVICE AND TAPE CASSETTE FOR PRINTING NORMAL IMAGE

BACKGROUND OF THE INVENTION

1. Field of the Invention

The present invention relates to a tape cassette housing a single-sided adhesive tape with a surface for printing and a surface with an adhesive layer.

2. Description of Related Art

A tape printing device which detachably loads a tape cassette housing a single-sided adhesive tape with a releasable sheet on one surface and a method for forming a tape-like printed medium by sticking the print surface to a surface of a double-sided adhesive tape without a releasable sheet after printing a reverse image on a print surface of a transparent film is known in the field of tape printing devices.

Besides the above publication, a tape printing device having two modes, including a normal mode for forming a tape-like printed medium after printing a normal image on a transparent film and then sticking the print surface and a surface without a releasable sheet of a double-sided adhesive tape together, and a reverse mode for printing a reverse image on said print surface, has been disclosed in Japanese utility model unexamined provisional publication No. 3-68443.

The tape-like printed medium formed by the former tape printing device and a tape-like printed medium formed by the latter tape printing device represent normal images when the sheets are peeled away and are adhesively secured to objects such as the back of file notes.

Also, the tape-like printed medium formed in the normal print mode represents a normal image when the medium is stuck to the inner side of a window pane and viewed from outside.

A tape cassette with a cassette case identical to that of latter tape printing device has been available for the purpose of normal image printing, and the tape cassette has a single-sided adhesive tape with a surface for printing and an opposite surface with an adhesive layer instead of a transparent film and a double-sided adhesive tape. The latter tape printing device forms a tape-like printed medium in the normal print mode when the tape cassette for normal image printing is loaded to the printing device. The tape-like printing medium formed in this process carries a normal image on its surface when it is adhesively secured to a object.

Since a tape cassette for normal image printing employs a cassette case identical to that of a tape cassette having a transparent tape and a double-sided adhesive tape inside, the tape cassette is compatibly loaded into a tape printing device without a normal image print mode.

Consequently, the former tape printing device mistakenly loaded with a tape cassette for the normal image printing mode prints a reverse image on the print surface of the single-sided adhesive tape and wastes tape medium.

SUMMARY OF THE INVENTION

The present invention has been designed to solve the above problem, and it is an object of the present invention to provide a tape cassette for normal image printing which prevents itself from being loaded into a tape printing device without the normal image printing mode.

A tape cassette for the normal image printing mode of the present invention can be installed into a tape printing device which detachably holds a tape cassette with a tape-like medium and a double-sided adhesive tape with a releasable sheet on one surface inside. The tape printing device has two modes, that is, a reverse image print mode in which the tape printing device prints a reverse image on the print surface and sticks the print surface to a surface without a releasable sheet of a double-sided adhesive tape and a normal image print mode in which the device prints a normal image on the print surface of said print medium. The tape cassette comprises a prohibiting member which prevents the tape cassette from being loaded into a tape printing device without the normal image printing mode. The tape cassette of the above construction can be loaded into a tape printing device with the normal image printing mode. However, the prohibiting member provided on the tape cassette prohibits the tape cassette from being loaded into a tape printing device without the normal image printing mode.

DETAILED DESCRIPTION OF PREFERRED EMBODIMENTS

Hereinafter, preferred embodiments of the present invention will be described with references to the figures.

Herein, the normal image printing mode refers to the mode in which a normal image is printed on a print medium thereby representing a normal image when it is read from the side of the print surface, and the reverse image printing mode refers to the mode in which the printed image represents a normal image when it is read from the opposite side to the print surface.

Figure 1:
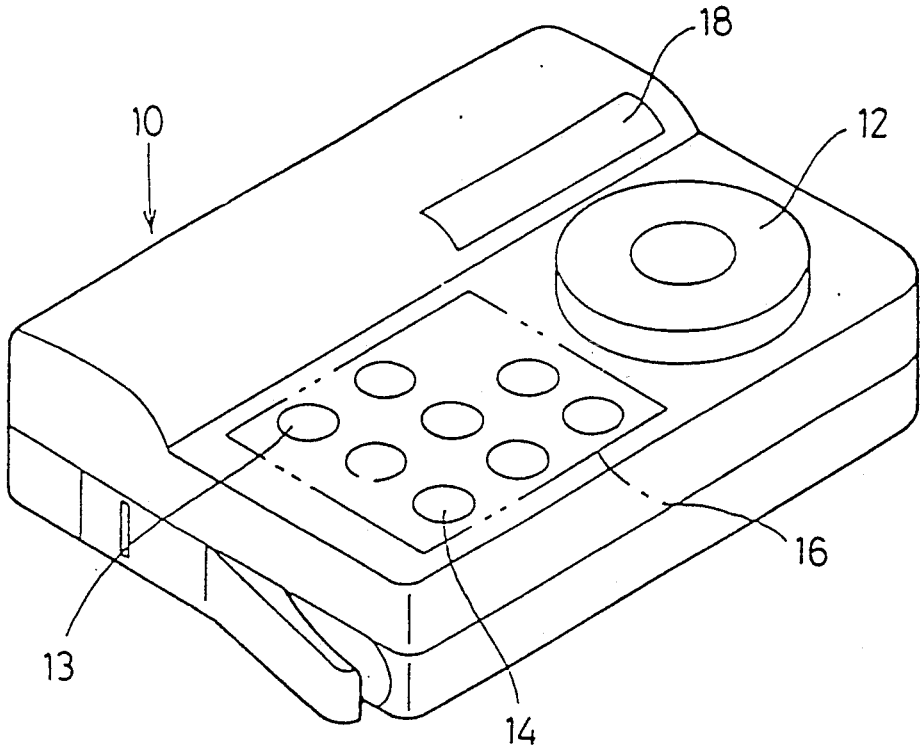
FIG. 1 is a perspective view showing the type-1 tape printing device.

As described in FIG. 1, a type-1 tape printing device 10 has a character input dial 12 on its upper face, and an operator can input characters by rotating it. The type-1 tape printing device 10 has a reverse image printing mode.

The tape printing device also has a function key group 16 including, for example, a power switch 13, a print execution key 14 for setting various conditions with the tape printing device 10 and a liquid crystal display (abbreviated as LCD) 18.

Figure 2:
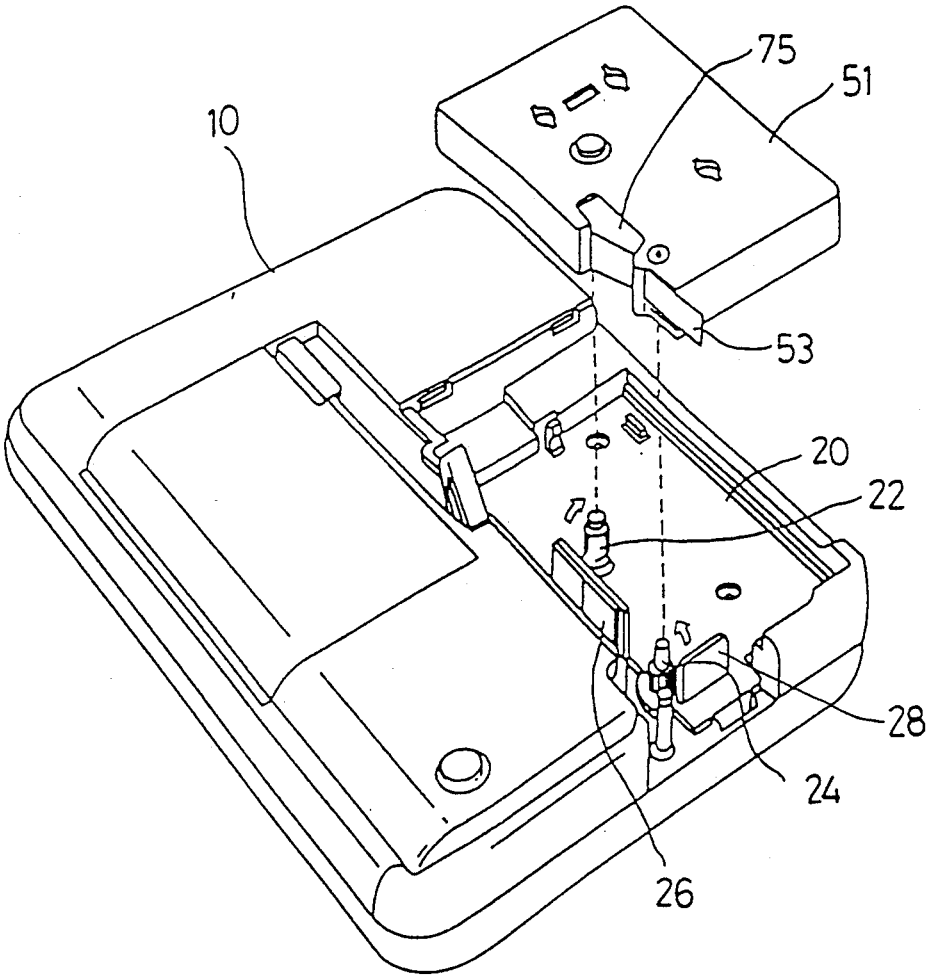
FIG. 2 is an exploded perspective view showing the back of the type-1 tape printing device.

As shown in FIG. 2, on the reverse face of the tape printing device 10 is a supporting member 20 for installing a tape cassette to be mentioned later, a ribbon winding cam 22 and a tape sending roller cam 24. The ribbon winding cam 22 and the tape sending roller cam 24 are driven by a motor (not shown) which drives the cams 22 and 24 in respective directions indicated by arrows in the figure.

Figure 9:
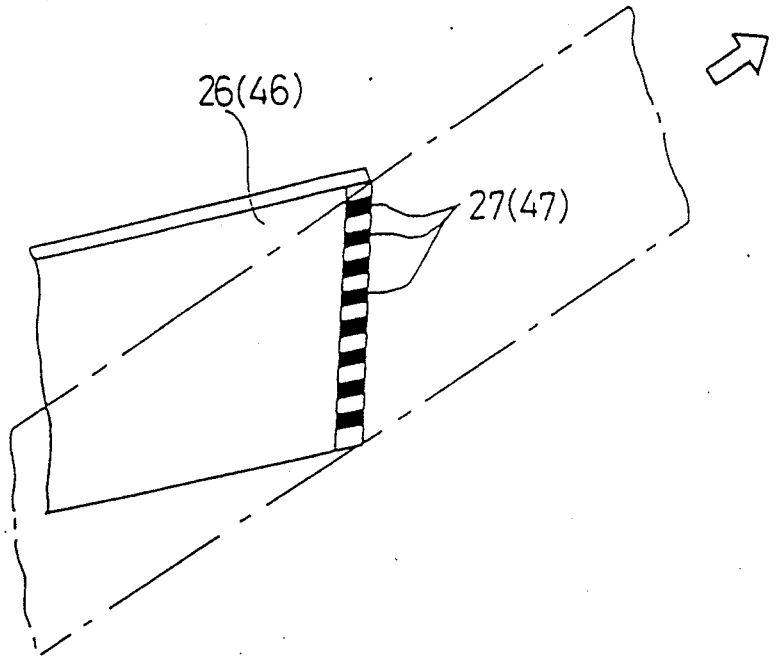
FIG. 9 is a perspective view of the thermal head.

Inside the supporting member 20 is a thermal head 26 provided upright on the member. The thermal head 26 is so positioned that it is located inside of an aperture 75 of a tape cassette 51 when the tape cassette is installed onto the supporting member 20. On the tip of the thermal head 26 is a thermal element 27 set across the width of the tape medium as illustrated in FIG. 9.

Also in the supporting member 20 is a reinforcement rib 28 stretching perpendicular to the direction the tape medium is sent. The reinforcement rib 28 is located in the groove 87 (shown in FIG. 5) of the tape cassette 51 when the tape cassette is installed to the supporting member 20.

Figure 3:
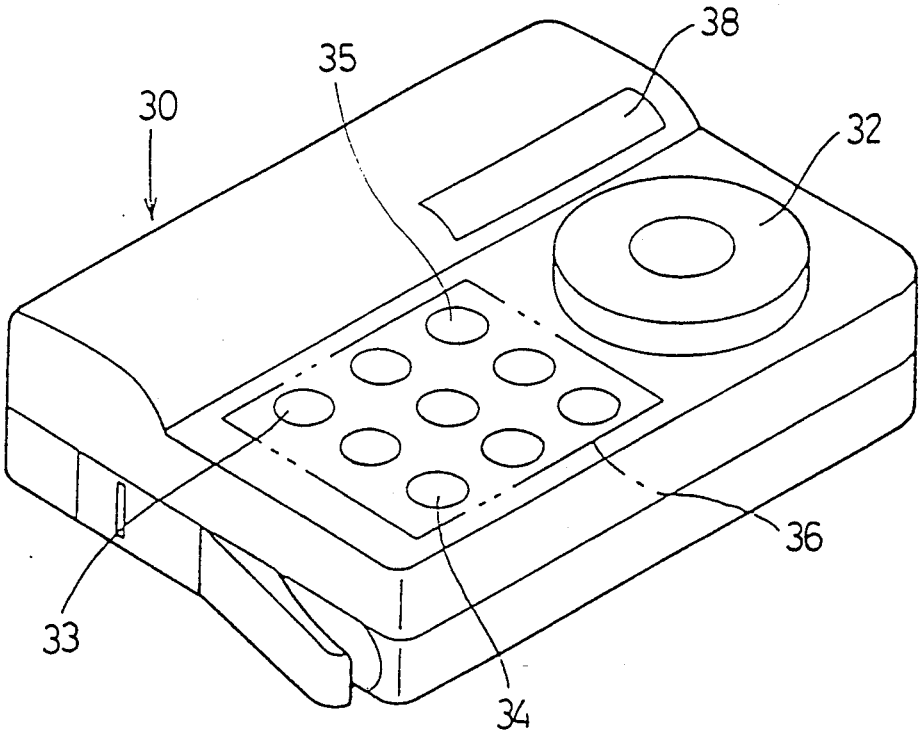
FIG. 3 is a perspective view showing the type-2 tape printing device.
Figure 4:
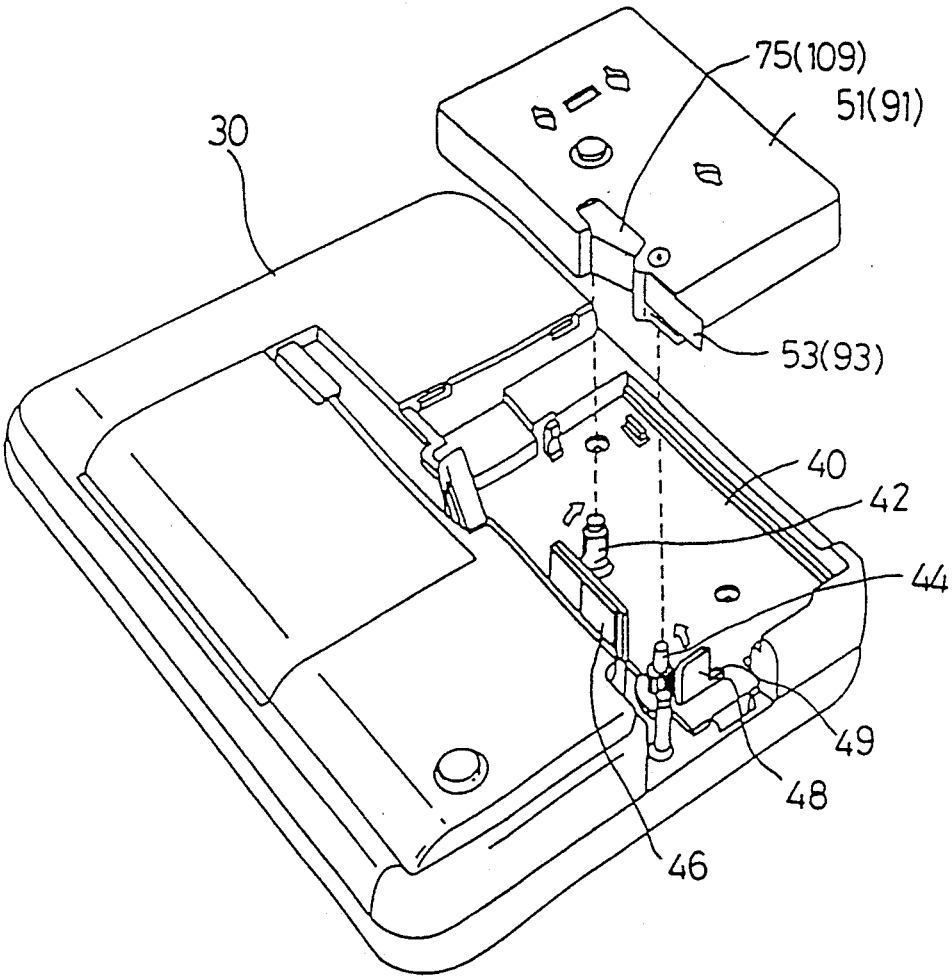
FIG. 4 is an exploded perspective view showing the back of the type-2 tape printing device.

Shown in FIGS. 3 and 4, the type-2 tape printing device 30 which has a normal image printing mode, the mode not provided in the type-1 tape printing device 10, has a character input dial 32, a function key group 36 and a LCD 38. The type-2 tape printing device 30 has a printing mode selection key 35 in the function key group 36.

Since the type-1 tape printing device 10 does not have a printing mode selection key 35 as found in the type-3 tape printing device 30, the type-1 tape printing device 10 has no optional mode other than the reverse image printing mode.

On the reverse side of the type-2 tape printing device 30 is a supporting member 40 for installing the tape cassette 51 or a normal image tape cassette 91, a ribbon winding cam 42, a tape sending roller cam 44, a thermal head 46 and a reinforcement rib 48. However, the reinforcement rib 48 is molded into a different shape compared with the reinforcement rib 28 of the type-1 tape printing device 10. In particular, the reinforcement rib 48 of the type-2 tape printing device 30 has a notch 49 on the opposite side to the tape sending roller cam 44.

Figure 5:
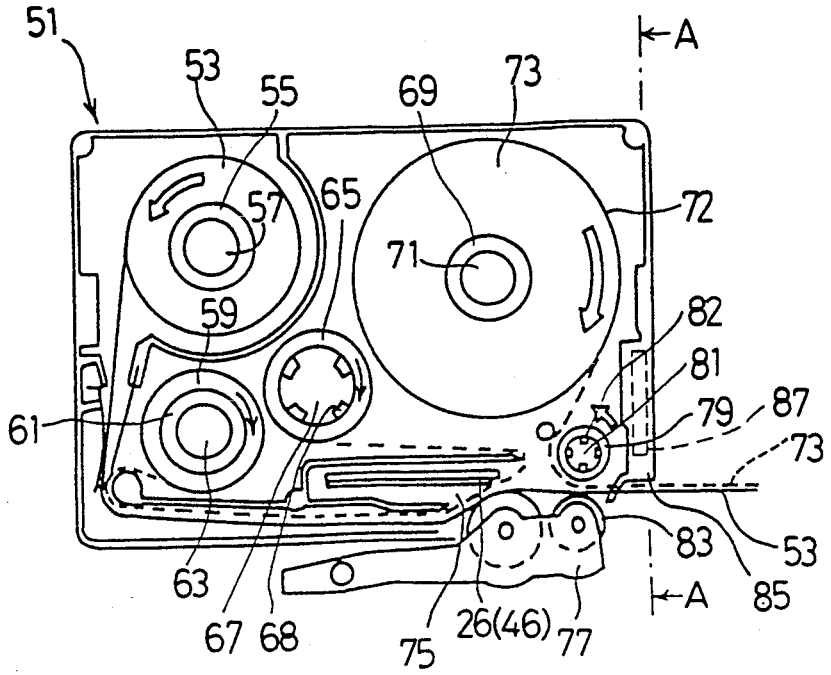
FIG. 5 is a plan view in partial section showing the internal structure of the tape cassette.
Figure 6:
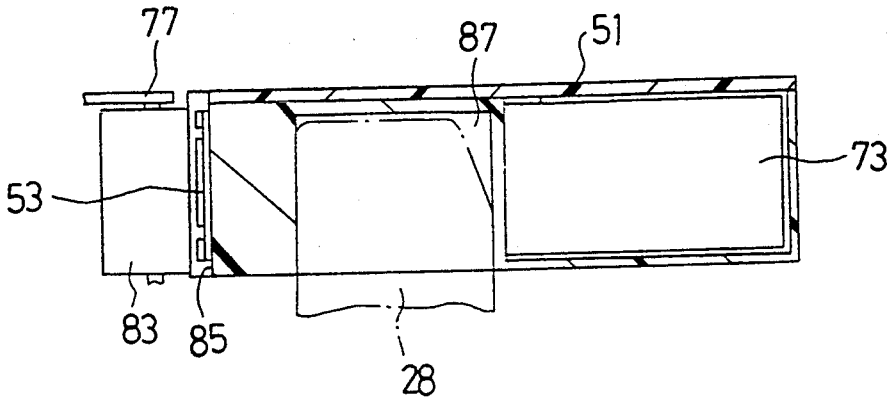
FIG. 6 is a cross-sectional view along line A—A in FIG. 5.

The tape cassette 51 which can be installed to the supporting member 20 or 40 of the type-1 tape printing device 10 or the type-2 tape printing device 30 has a tape spool 55 to which tape print medium 53 consisting of a tape-like transparent film is wound. As shown in FIG. 5, the tape spool 55 is rotatably installed around a rotation shaft 57 provided upright from the main body of the tape cassette 51. Since the tape print medium consists of a transparent film, a reverse image printed on the print surface represents a normal image when it is viewed from the opposite side of the tape. The tape print medium is used as a print medium in the embodiment of the present invention.

As viewed in FIG. 5, under the tape spool 55 is a ribbon supply spool 61 on which an ink ribbon 59 is wound. The ribbon supply spool 61 is rotatably installed on a rotation shaft 63 provided upright from the main body of the tape cassette 51.

On the right side of the ribbon supply spool 61 is a winding up spool 65 which winds up the ink ribbon 59. The winding up spool 65 is rotatably supported in hole 67 provided on the main body of the tape cassette 51. Inside the bore of the winding up spool 65 are engagement projections 68, and the engagement projections engage with the ribbon winding cam 22 or 42 when the tape cassette is installed on the supporting member 20 or 40.

On the right hand portion of the tape cassette 51 is a double-sided tape spool 69 rotatably installed around a rotation shaft 71 provided upright from the main body of the tape cassette 51. A double-sided adhesive tape 73 with a releasable sheet 72 stuck only on one side is wound up to the double-sided tape spool 69 with the releasable sheet 72 facing outward.

As shown in FIG. 5, an aperture 75 is provided in the center bottom portion of the tape cassette 51. The print medium 53 and the ink ribbon 59 are guided toward the aperture 75 with the print surface of the tape print medium and ink-coated surface of the ink ribbon 59 kept in confrontation. The tape print medium 53 and the ink ribbon 59 are welded with pressure by the thermal head 26 or 46 and a crimp release member 77. During this process the print surface of the tape print medium 53 faces the thermal head 26 or 46.

On the right side of said aperture 75 is a tape sending roller 79 rotatably supported in hole 81 formed on the main body of the tape cassette 51. Engagement projections 82 are molded inside the bore of the tape sending roller 79. When the tape cassette 51 is installed into the supporting member 20 or 40, the tape sending roller cam 24 is inserted into the tape sending roller 79, and the engagement projections engage with the tape sending roller cam 24 or 44.

A rotation roller 83 supported by the crimp release member 77 is arranged at the location where the tape cassette 51 and the tape sending roller 79 are set in confrontation after a tape cassette 51 is installed to said supporting member 20 or 40. The print surface of the tape print medium 53 and the surface without a releasable sheet of the double-sided adhesive tape 73 are kept in confrontation and guided between the tape sending roller 79 and the rotation roller 83. The tape print medium 53 and the double-sided adhesive tape 73 are stuck to each other by the tape sending roller 79 and the rotation roller 83.

On the right of said tape sending roller 79, in other words, at the right side bottom of the tape cassette 51 is a reception mount 85, which a movable blade (not shown) is pressed against. Above the reception mount 85 is a groove 87 provided with its aperture facing the back of the tape cassette 51, to which the reinforcement rib 28 or 48 is inserted when tape cassette is installed into the supporting member 20 or 40. The reception mount 85 is thus enforced against the pressure of said movable blade by the reinforcement rib 28 or 48 inserted in the groove 87.

Figure 7:
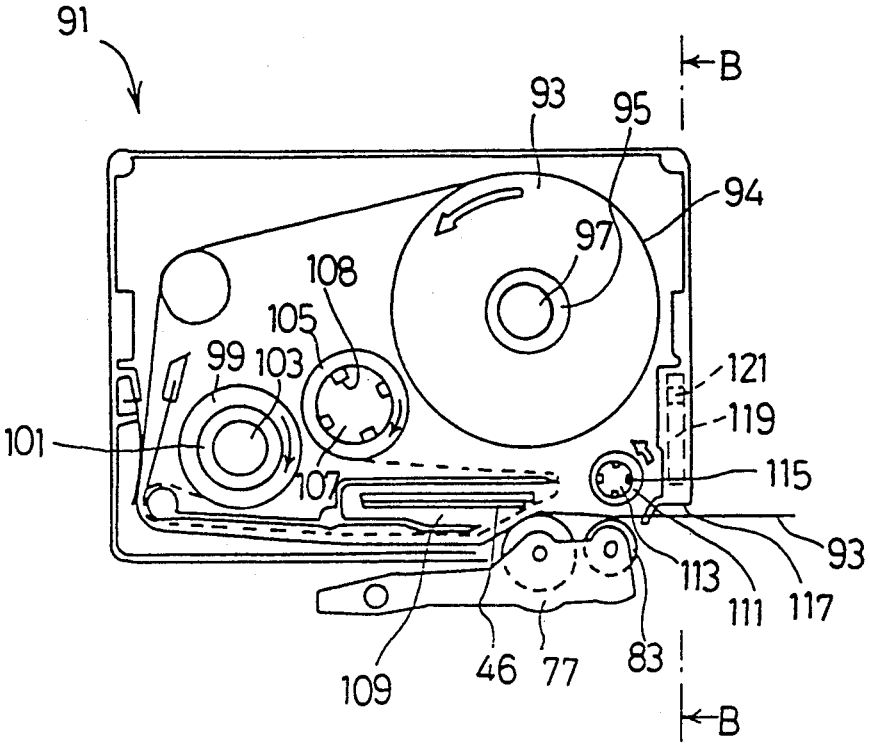
FIG. 7 is a plan view in partial section showing the internal structure of the normal image tape cassette.

On the other hand, the normal image tape cassette 91 shown in FIG. 7 is molded into the same appearance as the tape cassette 51. In the upper right portion inside the normal image tape cassette 91 as viewed in FIG. 7 is a tape spool 95 rotatably installed around a rotation shaft 97 extending from the main body of the cassette. The print tape medium 93 has an adhesive layer on an opposite side to the print surface and a releasable sheet 94 stuck on the adhesive layer. The tape print medium 93 is wound to the tape spool 95 with the releasable sheet 94 facing outward. The tape print medium 93 constitutes the single-sided adhesive tape used in this embodiment of the invention.

As shown in the lower left side of the normal image tape cassette 91 is a ribbon supply spool 101, to which an ink ribbon is wound, rotatably installed around a rotation shaft 103 extending from the main body of the normal image tape cassette 91.

On the right side of the ribbon supply spool 101 is a winding up spool 105 rotatably installed in hole 107 formed on the main body of the normal image tape cassette 91. Engagement projections 108 are molded inside the bore of the winding up spool 105. The ribbon winding up cam 42 is inserted into the winding up spool 105, and engages with the engagement projection 108 when the normal image tape cassette is installed on the supporting member of the type-2 tape printing device 30.

As shown in FIG. 7 an aperture 109 is provided in the center bottom of the tape cassette 91. The tape print medium 93 and the ink ribbon 99 are guided to the aperture 109 with the print surface of the tape print medium 93 and the ink-coated surface of ribbon 99 kept in confrontation. After the normal image tape cassette 91 is installed to the supporting member 40 of the type-2 tape printing device 30 the tape print medium 93 and the ink ribbon 99 are welded with pressure by the thermal head 49 and the crimp release member 77 at the aperture 109. In this process, the print surface of the tape print medium 93 faces the thermal head 46.

On the right side of the aperture 109 is a tape sending roller 111 rotatably installed in hole 113 formed on the main body of the normal image tape cassette 91. Engagement projections 115 are molded inside the bore of the tape sending roller 111. When the normal image tape cassette 91 is installed to said supporting member 40, the roller cam 44 is inserted into the tape sending roller 111, and the engagement projections 115 engage with the roller cam 44.

Figure 8:
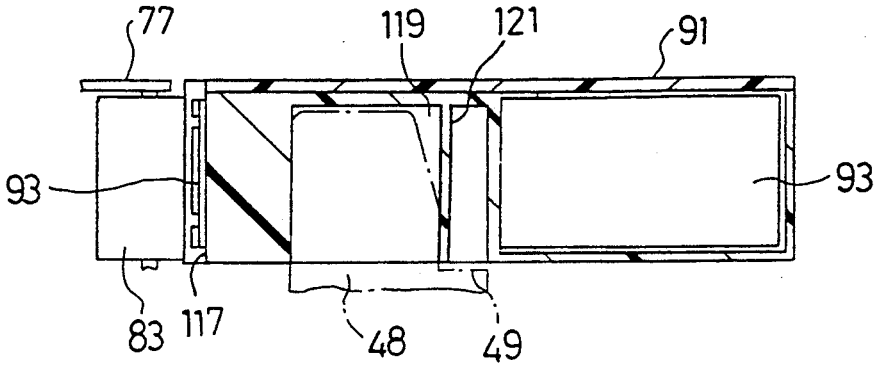
FIG. 8 is a cross-sectional view along the line B—B in FIG. 7.

On the right side of the tape sending roller 111, in other words, lower right portion of the normal image tape cassette is a reception mount 117 which a movable blade (not shown) is pressed against. As shown in FIG. 7 and 8, above the reception mount 117 is a groove 119. The reinforcement rib 48 is installed into the groove 119 thereby reinforcing the reception mount 117 against the pressure of said movable blade.

A rib 121 is molded inside the groove 119. The rib abuts the upper end of the reinforcement rib 28 and prevents the normal image tape cassette 91 from being installed to the supporting member 20 of the tape printing device 10. Meanwhile, when the normal image tape cassette 91 is installed to the supporting member 40 of the type-2 tape printing device 30, the rib 121 corresponds to the notch 49 provided on the reinforcement rib 48, thus the normal image tape cassette 91 can be installed to the supporting member 40 of the tape printing device 30 without hindrance.

However, the tape cassette 51 can be installed either to the supporting member 20 of the type-1 tape printing device 10 or to the support member 40 of the type-2 tape printing device 30. Since the type-1 tape printing device 10 operates only in the normal image print mode, an instruction to print characters "ABC" causes the printing device 10 to drive the thermal head 26 and print a reversed image of characters "ABC" as shown in FIG. 10B on the print surface of the tape print medium 53. The surface of the tape print medium 53 carrying characters printed thereon is stuck to the surface without a releasable sheet of the double-sided adhesive tape 73, and the tape is discharged out of the tape cassette 51.

Selecting the normal image printing mode by the print mode selection key 35 and giving the type-2 tape printing device 30 with a tape cassette 51 the instruction to print characters "ABC" cause the printing device to drive the thermal head 26 and print a reversed image of characters "ABC" as shown in FIG. 10B.

Figure 10A:
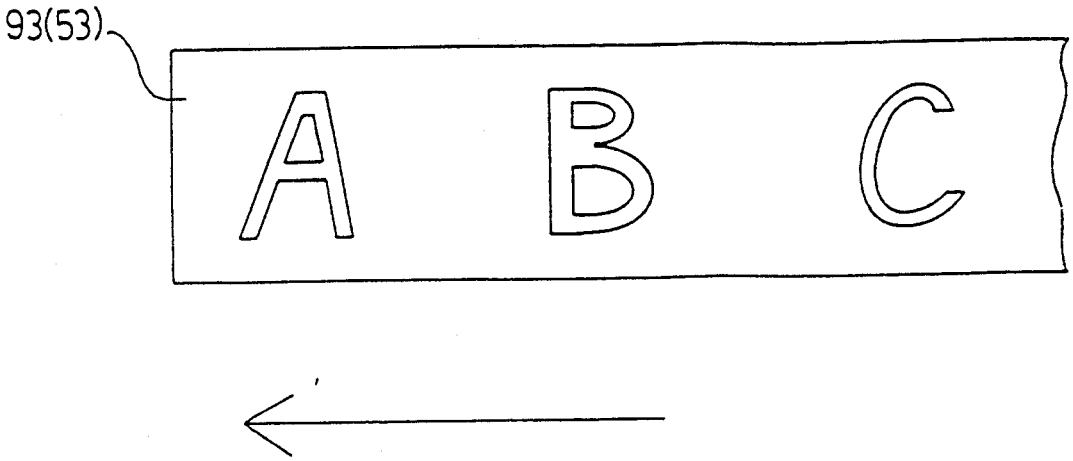
FIG. 10A is a view from the print surface of a tape medium carrying a normal image.
Figure 10B:
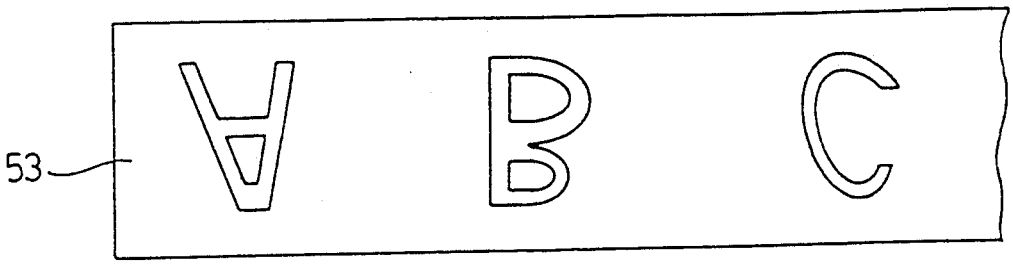
FIG. 10B is a view from the print surface of a tape medium carrying a reverse image.

After installing a tape cassette 51 to the type-2 tape printing device 30 and switching the print mode selection key to the normal image print mode, the instruction to print characters "ABC" causes the type-2 tape printing device 30 to drive thermal head 46 and print a normal image of characters "ABC" on the surface of the tape print medium 53 as shown in FIG. 10A. The surface of the tape printing medium on which characters are printed is stuck to the surface without a releasable sheet 72 of the double-sided adhesive tape 73, and the tape is discharged from the tape cassette 51.

The tape print medium made in this process represents a reverse image when viewed from the non-stick side of the tape print medium 53. However, the tape print medium represents a normal image when the tape is stuck to inside of a window pane and viewed from outside.

On the other hand, the normal image tape cassette 91 has a rib 121 in its groove 119. The rib 121 abuts the reinforcement rib 28 provided in the supporting member 20 and prevents the tape cassette from being installed to the type-1 tape printing device 10 Thus the prohibiting member eliminates the chance of the improper installation of the normal image tape cassette 91 to the type-1 tape printing device 10 without the normal image print mode, thereby saving print medium which otherwise would be wasted.

The reinforcement rib 48 of the type-2 tape printing device 30 has a notch 49. The notch 49 allows the normal image tape cassette to be installed to the type-2 tape printing device 30. Giving the instruction to print characters "ABC" to the type-2 tape printing device in the normal image print mode causes the printing device to print a normal image on the print surface of the tape print medium 93 as shown in the FIG. 10A.

As apparent from the detailed description above, the present embodiment of the invention provides a normal print mode tape cassette which prohibits improper installation of a tape cassette to a tape printing device without a normal image print mode.

While the present invention has been described in connection with the preferred embodiment, it will be understood that it is not intended to limit the invention to this embodiment. On the contrary, it is intended to cover all alternatives, modifications and equivalents as may be included within the spirit and scope of the invention as defined by the appended claims.

What is claimed is:

1. A tape cassette for a tape printing device of one of two types corresponding to normal and reverse image print modes, comprising:

a cassette housing that houses tape print medium for at least one of a normal and reverse print mode, said housing shaped to mate with a supporting portion of both types of tape printing devices; and a prohibiting member extending from said housing, prohibiting insertion of the tape cassette into one of the types of tape printing devices by interfering with the supporting portion of the tape printing device and allowing insertion of the tape cassette into the other type of tape printing device by mating with the supporting portion.

2. The tape cassette of claim 1, wherein said tape print medium includes a print surface on one side thereof, an adhesive layer on an opposed side thereof and a releasable sheet adhered to said adhesive layer, said tape print medium being compatible with the normal image print mode.

3. The tape cassette of claim 1, wherein said prohibiting member is an outwardly extending rib.

4. The tape cassette of claim 1, wherein said prohibiting member is an integrally molded formation on said housing.

5. The tape cassette of claim 1, wherein said cassette housing has a groove therein for receiving a support member on the tape printing device and said prohibiting member is a formation in said groove.

6. The tape cassette of claim 5, wherein said formation is a rib extending into said groove.

7. A tape printing assembly comprising:

a tape printing device for printing at least one print mode on a corresponding tape print medium, comprising a printer that prints said at least one print mode on the corresponding tape print medium, and a support for receiving a corresponding tape cassette, said support including a rib for interlocking with the corresponding cassette housing, said rib having a formation therein for receiving a prohibiting member on a corresponding tape cassette; and a tape cassette for said tape printing device, comprising a cassette housing that houses corresponding tape print medium for said tape printing device, and a prohibiting member coupled to said housing that prohibits insertion of the tape cassette into a tape printing device with a non-corresponding print mode.

8. The tape printing assembly of claim 7, wherein said tape print medium includes a print surface on one side thereof, an adhesive layer on an opposed side thereof and a releasable sheet adhered to said adhesive layer, said tape print medium being compatible with the at least one print mode.

9. The tape printing assembly of claim 7, wherein said prohibiting member is an outwardly extending rib.

10. The tape printing assembly of claim 7, wherein said prohibiting member is an integrally molded formation on said housing.

11. The tape printing assembly of claim 7, wherein said cassette housing has a groove therein for receiving said rib on said tape printing device and said prohibiting member is a formation in said groove.

12. The tape printing assembly of claim 11, wherein said formation is a rib extending into said groove.

13. The tape printing assembly of claim 11, wherein said formation is a notch formed in said rib and said notch is compatible with said prohibiting member on said tape cassette.

14. A tape printing assembly, comprising:

a first tape printer that prints in a first printing mode and having a first support that receives a compatible tape cassette, said first support including a first reinforcement rib extending therefrom;

a second tape printer that prints in at least a second printing mode and having a second support that receives a compatible tape cassette, said second support including a second reinforcement rib extending therefrom, said second reinforcement rib being shaped differently from said first reinforcement rib;

a first tape cassette including printing tape compatible with the first printing mode and the second printing mode and a housing shaped to interchangeably mate with said first support of said first tape printer and said second support of said second tape printer, said housing having a first groove that mates with said first reinforcement rib and said second reinforcement rib; and a second tape cassette including printing tape compatible with the second printing mode and a housing shaped to mate with said second support of said second tape printer, said housing having a second groove that mates with said second reinforcement rib and interferes with said first reinforcement rib.

15. The tape printing assembly of claim 14, wherein said second reinforcement rib has a notch therein and said second groove has a rib therein, said notch and said rib being aligned when said second tape cassette is assembled into said second tape printer.

* * * * *